United States Patent [19]

Krause

[11] 3,990,755

[45] Nov. 9, 1976

[54] TOOTHBRUSH HOLDER

[76] Inventor: Arthur A. Krause, 1147 S. 74 East Ave., Tulsa, Okla. 74112

[22] Filed: Apr. 7, 1975

[21] Appl. No.: 566,040

[52] U.S. Cl. ..... 312/207; 211/66; 248/110; 248/316 D

[51] Int. Cl.[2] ..... A47B 17/00; A47G 29/08

[58] Field of Search ..... 312/206, 207; 211/65, 211/66, 74; 248/108, 109, 110, 316 D, 113; 206/362.3

[56] References Cited

UNITED STATES PATENTS

| | | | |
|---|---|---|---|
| 670,481 | 3/1901 | Kirkwood | 312/207 |
| 1,181,862 | 5/1916 | Dye | 312/206 X |
| 1,369,460 | 2/1921 | Morrison | 312/206 |
| 1,375,865 | 4/1921 | Sulak | 312/207 |
| 2,028,694 | 1/1936 | Spinks | 312/207 |
| 3,156,364 | 11/1964 | Wolcott | 248/110 X |

FOREIGN PATENTS OR APPLICATIONS

| | | | |
|---|---|---|---|
| 782,853 | 6/1935 | France | 312/207 |
| 255,259 | 6/1948 | Switzerland | 312/207 |

*Primary Examiner*—Philip C. Kannan
*Attorney, Agent, or Firm*—Head, Johnson & Chafin

[57] ABSTRACT

A holder for toothbrush including an elongated upright tubular body of an internal diameter to slidably receive the brush portion of the toothbrush and having, intermediate its length, an integral internal circumferential shoulder, the lower surface of the shoulder being tapered conically upwardly to a reduced internal diameter of a dimension to slidably receive the handle portion of the toothbrush and to receive, with some resistance, the brush portion of a toothbrush, such that when the brush portion is forced upwardly through the reduced internal diameter the brush portion is retained within the holder where it is protected. When the user wishes to withdraw the toothbrush, the handle portion is pulled downwardly, pulling the brush portion back through the restriction. The upper surface of the reduced internal diameter portion is a horizontal circumferential ledge which assists in retaining the brush in the stowed position. The holder may include end caps which may be removed for cleaning and for use when the holder is to be transported.

3 Claims, 5 Drawing Figures

10
12
14
16
16A
16B
16C
18
18A
18B
20
22
24
26
28
28A
30
32
32A
34
36
36A
38
W

TOOTHBRUSH HOLDER

BACKGROUND, SUMMARY AND OBJECTS OF THE INVENTION

It is desirable to store toothbrushes in a way that the brush portion is not freely contacted by objects which might contaminate. To achieve this result others have devised various toothbrush holder apparatus such as revealed in the following U.S. Pat. Nos.: 1,200,236; 2,484,157; 1,375,865; 2,667,395; 2,181,862; 1,262,456; 1,579,958; 1,582,389; and 2,626,199.

The present invention is directed toward a toothbrush holder having advantages and superiorities over those shown in these prior patents.

It is therefore an object of this invention to provide an improved toothbrush holder.

Another object of this invention is to provide a toothbrush holder which may be used either in a semi-permanent location, such as in the bathroom of the user, or which may be, when desired, utilized as a transportable holder so that the user may avail himself of the holder on trips, vacations and so forth.

These general objects, as well as other and more specific objects of the invention, will be fulfilled in the following description and claims, taken in conjunction with the attached drawings.

DESCRIPTION OF VIEWS

DETAILED DESCRIPTION

Figures 1, 2, 3, 4, 5:
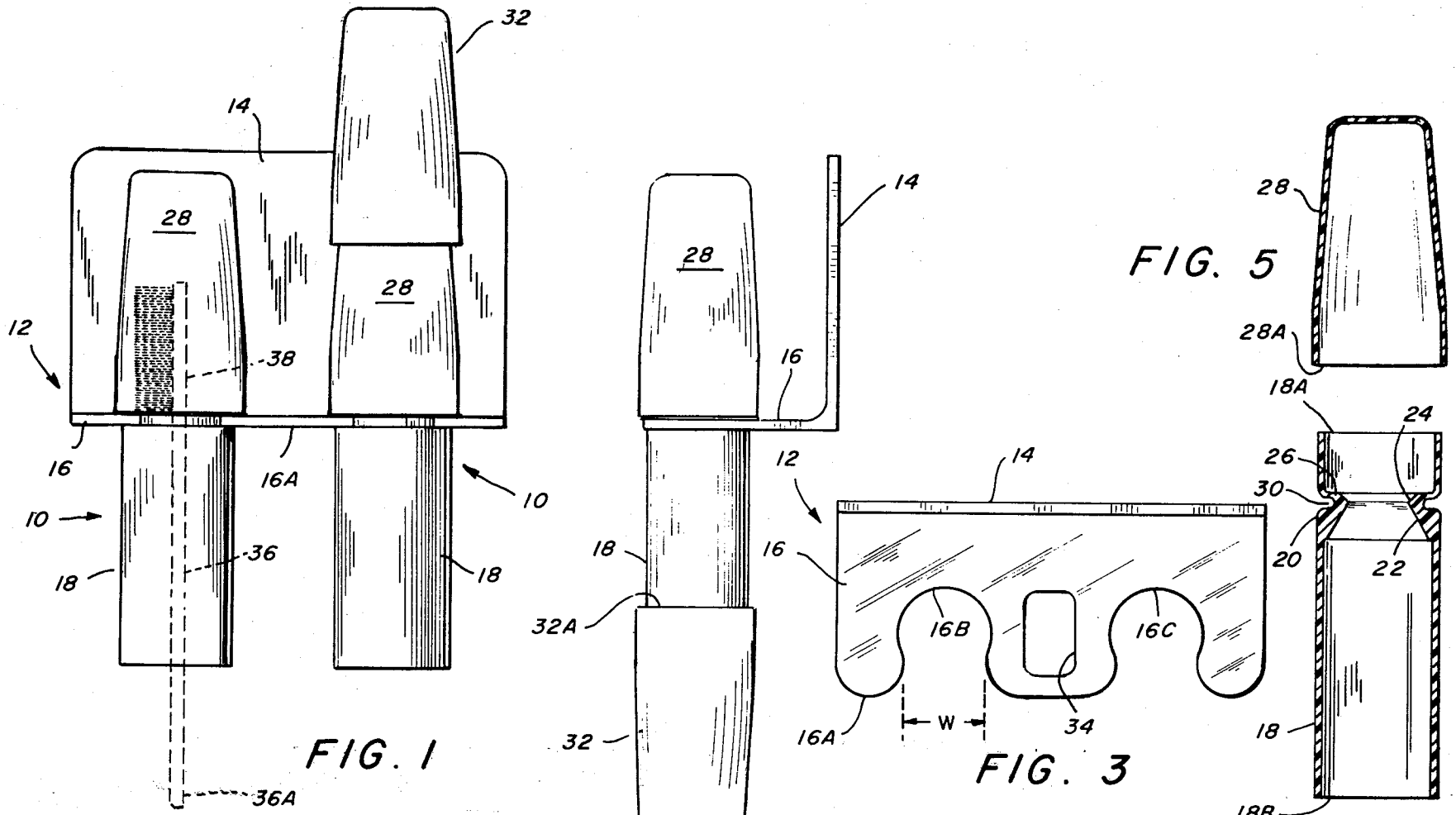
FIG. 1 is a front elevational view of two of the holders of this invention supported by a bracket as the holder would be utilized in the bathroom of the user.
FIG. 2 is a side view of the holder and bracket as shown in FIG. 1.
FIG. 3 is a top view of the bracket.
FIG. 4 is a cross-sectional side elevational view of the toothbrush holder showing the basic body member.
FIG. 5 is a cross-sectional view of an end cap which is preferably employed with the holder.

Referring to the drawings and first to FIG. 1, two toothbrush holders indicated generally by the numeral 10, are shown supported by a bracket, generally indicated by the numeral 12. The bracket 12 includes a vertical portion 14 which may typically be mounted on the inside of a medicine cabinet wall or on the bathroom wall of the user, such as by the means of screws, adhesive or so forth. The bracket 12 further includes an integral horizontal portion 16 which, as shown in FIG. 3, includes a forward edge 16A into which is formed U-shaped openings 16B and 16C. It can be seen that only one such opening is required of the bracket and while the bracket is illustrated having two recesses 16B and 16C, it can be seen that, if desired, one, two, three or any other number may be employed. The U-shaped openings 16B and 16C serve to retain the toothbrush holders 10 as will be described.

Each of the toothbrush holders 10 includes an elongated upright tubular body portion 18. The internal diameter of the body portion 18 is such as to easily slidably receive the brush portion of a toothbrush. Intermediate the length of the body portion 18 is an integral internal circumferential shoulder portion 20 (See FIG. 4).

The lower portion of the internal shoulder 20 is defined by an upwardly tapered conical surface 22 which tapers upwardly to a reduced internal diameter passage

24. The reduced internal diameter passage 24 is dimensioned such that it freely slidably receives the handle portion of a toothbrush but passes the brush portion of a toothbrush with some resistance. Thus, a brush portion of a toothbrush may be forced upwardly past the conical surface 22 and the reduced internal diameter passage 24. The upper portion of the internal shoulder 20 is formed of a circumferential substantially horizontal ledge 26 against which the lower end of the brush portion of a toothbrush is supported after the brush is forced upwardly past the shoulder portion 20.

The portion of the body member 18 above the horizontal ledge 26 must be closed and of a dimension to freely receive the brush end of a toothbrush. In the illustration of FIG. 4 the upper end is opened and is closed by a removable opened bottom upper closure 28. The dimension of the opened lower end 28A of the top closure is of a diameter slightly greater than the external diameter of the upper end 18A of the body portion so that the closure 28 slidably fits on the upper end to keep it closed as shown in FIGS. 1 and 2.

Formed in the outer circumferential surface of the tubular body portion 18 intermediate the ends and preferably at the area thereof including the internal shoulder 20, is a circumferential notch 30. The height of the notch 30 is slightly greater than the thickness of the bracket horizontal portion 16. The diameter of the external surface of the body member at the bottom of the notch 30 is slightly greater than the width W as shown in FIG. 3 at the forward end of the U-shaped openings. The rearward portion of the opening 16B and 16C is semicircular and of a diameter slightly greater than the diameter of the tubular body at the bottom of notch 30. Thus the tubular body 18 may be vertically supported by sliding it into a notch 16B or 16C of the bracket of FIG. 3. When it is desired to remove the tubular body 18, such as to use the holder for traveling purposes, it can be easily slid out by pulling forward, however, it will normally be retained in position on the horizontal portion 16 of the bracket.

When the holder is to be utilized in a stationary positions, such as in a bathroom, the bottom end will normally be left open. However, when used for traveling purposes it will be desirable that the entire holder be closed. For this purpose, a lower closure 32 is employed. The closure 32 is preferably the same dimensions and configurations as the upper closure 28, that is, the upper end 32A has an internal diameter to slidably extend over the lower end 18B of the tubular body. The upper and lower closures each preferably include air vent holes. When the upper closure 28 and lower closure 32 are tapered as illustrated, the lower closure 32 may be stored on top of the upper closure as shown in the right hand portion of FIG. 1.

While the tubular body may be constructed such that the upper end is integrally closed, the construction wherein the upper end closure 28 is utilized is preferred since in this manner cleaning of the interior of the holder is easier.

It can be seen that the holder described has advantages over the toothbrush holder presently known, including those in the patents previously mentioned. The holder is simple, economical, and highly effective. It includes improved means of receiving a toothbrush and retaining it in position. It includes improved means for closing the upper end of the holder to facilitate cleaning and the holder may be equally used for permanent installation and travel.

As shown in FIG. 3, an opening 34 may be provided in the bracket horizontal portion 16 between the U-shaped openings 16B and 16C. This reduces the width of material adjacent the sides of the openings 16B and 16C so that it is more easily flexible when the notched portion 30 is forced into one of the openings.

In FIG. 1 in the lefthand view, a toothbrush is shown in dotted outline as it would be received within the lefthand toothbrush holder. The toothbrush includes an elongated handle portion 36 and a brush portion 38. The reduced internal diameter passage 24 of the internal shoulder 20 is such as to permit the brush portion 38 to pass with some restriction but that, after passage, the lower end of the brush portion 38 rests upon the horizontal circumferential ledge 26 so that the brush is easily retained in position. When it is desired to remove the toothbrush the user grasps the lower end 36A of the toothbrush handle and pulls it downwardly forcing the brush portion 38 back through the reduced diameter passage 24. Thus the construction of the internal shoulder 20 with the upwardly conically tapered lower surface 22 facilitates easy positioning of the brush into the holder and reduces the chance of the brush inadvertently falling out of the holder.

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but it is to be limited only by the scope of the attached claim or claims, including the full range of equivalency to which each element thereof is entitled.

What is claimed:

1. A holder for a toothbrush having an elongated handle portion and a brush portion at one end, the holder comprising:

an elongated upright open ended tubular body member of an internal diameter to slidably receive a toothbrush brush portion and having, intermediate the length thereof, an integral internal circumferential shoulder, the lower portion of the shoulder tapering conically upwardly to a reduced internal diameter of a dimension to slidably receive the handle portion of a toothbrush and to receive, with resistance, the brush portion of a toothbrush such that the brush portion may be forcibly passed therethrough, the upper portion of the internal shoulder forming a circumferential substantially horizontal ledge against which the lower end of a brush portion is supported after the brush portion is forced upwardly through the shoulder portion, the upper end of the tubular member being of a length to receive a toothbrush brush portion above the internal shoulder;

an opened bottom, closed top removable upper closure member removably engageable with the upper end of said upright tubular body member, the upper closure being externally tapered towards said closed end, and an opened top, closed bottom lower closure member removably engageable with the lower end of said upright tubular body member and telescopically extendable over the tapered upper end of said upper closure member whereby said lower closure member may be stored on said upper closure member.

2. A toothbrush holder according to claim 1 wherein said tubular body member has an external circumferential groove intermediate the upper and lower ends thereof; and:

a wall bracket having a flat horizontal portion with a forward edge, the horizontal portion having a U-shaped slot therein communicating with said forward edge, the width of said slot being dimensioned to slidably receive said tubular body portion circumferential groove to removably retain said body portion therein.

3. A toothbrush holder according to claim 2 wherein said flat horizontal portion of said wall bracket includes:

two U-shaped slots therein communicating with said forward edge, said slots being spaced from each other and each being dimensioned to snugly slidably receive said tubular body portion circumferential groove, said bracket horizontal portion having a hole therein intermediate said spaced slots providing reduced width between said hole and each adjacent slot whereby when a said tubular body portion is forced into a said slot a slight deflection of said bracket horizontal portion between said opening and said hole takes place.

* * * * *